US006965283B2

(12) United States Patent
Andoh et al.

(10) Patent No.: US 6,965,283 B2
(45) Date of Patent: Nov. 15, 2005

(54) DIELECTRIC RESONATOR DEVICE, COMMUNICATION FILTER, AND COMMUNICATION UNIT FOR MOBILE COMMUNICATION BASE STATION

(75) Inventors: Masamichi Andoh, Kyoto (JP); Kunihiro Komaki, Nagaokakyo (JP); Munenori Tsutumi, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/799,777

(22) Filed: Mar. 15, 2004

(65) Prior Publication Data

US 2004/0196120 A1 Oct. 7, 2004

(30) Foreign Application Priority Data

Apr. 2, 2003 (JP) ..... 2003-099676

(51) Int. Cl.[7] ..... H01P 1/201; H01P 7/10
(52) U.S. Cl. ..... 333/202; 333/219.1
(58) Field of Search ..... 333/202, 208, 333/212, 219.1, 134

(56) References Cited

U.S. PATENT DOCUMENTS 4,721,933 A * 1/1988 Schwartz et al. ..... 333/212
5,708,404 A * 1/1998 Kurisu et al. ..... 333/202
6,081,173 A * 6/2000 Sonoda et al. ..... 333/202

FOREIGN PATENT DOCUMENTS

| | | |
|---|---|---|
| EP | 0 759 645 A2 | 2/1997 |
| JP | 07-202530 | 8/1995 |
| JP | 07-283602 | 10/1995 |
| JP | 07-321506 | 12/1995 |
| JP | 07-336102 | 12/1995 |
| JP | 8-32305 | 2/1996 |

OTHER PUBLICATIONS

Copy of European Search Report dated Jun. 21, 2004.

* cited by examiner

*Primary Examiner*—Seungsook Ham
(74) *Attorney, Agent, or Firm*—Dickstein, Shapiro, Morin & Oshinsky, LLP.

(57) ABSTRACT

A dielectric resonator device includes two dielectric resonators resonating in first and second resonant modes and a partitioning plate which partitions the two dielectric resonators. Slits S are provided in the partitioning plate. A magnetic loop of the first resonant mode (TE01δz mode) is directed along the length of the slits S. The partitioning plate is also provided with a conductor loop consisting of first and second conductor loop portions that are coupled to magnetic fields of the second resonant mode (TE01δy mode). Accordingly, the coupling of the second resonant mode between the two dielectric resonators can be suppressed by the coupling of a leakage of the magnetic fields passing through the slits S and the coupling of the magnetic fields by the provision of the conductor loop.

20 Claims, 13 Drawing Sheets

DIELECTRIC RESONATOR DEVICE, COMMUNICATION FILTER, AND COMMUNICATION UNIT FOR MOBILE COMMUNICATION BASE STATION

BACKGROUND OF THE INVENTION

1. Field of the Invention

The present invention relates to a dielectric resonator device in which a plurality of resonators are formed in a cavity, and also relates to a communication filter and a communication unit for a mobile communication base station using the above type of dielectric resonator device.

2. Description of the Related Art

A known dielectric resonator device, which is used in a filter, formed by providing a plurality of dielectric resonators in a cavity is disclosed in Japanese Unexamined Patent Application Publication No. 7-321506.

In this publication, a plurality of dielectric cores, each having two dielectric rectangular parallelepipeds intersecting with each other, are provided in cavities so as to form a plurality of TM double mode dielectric resonators. This publication also discloses a structure in which a partitioning plate having a plurality of slits in a predetermined direction is disposed between adjacent TM double mode dielectric resonators so that magnetic coupling of the same type of mode of the double modes is conducted between adjacent dielectric resonators. By the provision of this partitioning plate, magnetic fields oriented along the length of the slits are allowed to pass through the partitioning plate, while magnetic fields oriented along the width of the slits are shielded, thereby making it possible to couple the same predetermined type of resonant mode.

The direction in which magnetic fields are allowed to pass through the partitioning plate can be determined by the number, the width, and the aspect ratio of the slits, etc. If, for example, the width of the slits is decreased, the effect of shielding magnetic fields orienting along the width of the slits can be enhanced. However, the magnetic fields cannot be completely shielded, and the resonators disposed across the partitioning plate are slightly coupled to each other due to such magnetic fields. If such a coupling is undesirable, a predetermined filter characteristic cannot be obtained. It is also difficult to reduce the width of the slits formed in the partitioning plate to further than a predetermined value in terms of the manufacturing process.

Additionally, the ratio of the permeability of magnetic fields along the length of the slits to that along the width of the slits can be changed to a certain degree by the aspect ratio. However, this permeability ratio is fixed by the shape of the slits formed in the partitioning plate. Accordingly, the optimal coupling coefficient between adjacent resonators cannot be separately adjusted for the two modes in which magnetic fields are directed along the length of the slits and magnetic fields are directed along the width of the slits.

SUMMARY OF THE INVENTION

Accordingly, it is an object of the present invention to provide a resonator device in which the amounts by which coupling of one type of resonant mode and coupling of the other type of resonant mode are conducted, which are selectively determined by the provision of a partitioning plate, can be varied, and also to provide a communication filter and a communication unit for a mobile communication base station using this type of resonator device.

It is another object of the present invention to provide a resonator device in which, among two resonant modes selectively coupled by the provision of a partitioning plate, coupling is allowed for only one type of resonant mode while inhibiting coupling for the other type of resonant mode, and also to provide a communication filter and a communication unit for a mobile communication base station using this type of resonator device.

In order to achieve the above-described objects, the present invention provides a dielectric resonator device including: at least two adjacent dielectric resonators that resonate in at least first and second resonant modes; and a partitioning plate for partitioning the two adjacent dielectric resonators. In the two adjacent dielectric resonators, the surfaces formed by magnetic loops by the first and second resonant modes are orthogonal with each other. The partitioning plate is provided with slits, the magnetic loop of the first resonant mode of the two adjacent dielectric resonators passing along the length of the slits. The partitioning plate is also provided with a conductor loop including a first conductor loop portion coupled to the second resonant mode of one of the two adjacent dielectric resonators and a second conductor loop portion coupled to the second resonant mode of the other dielectric resonator.

The above-described slits allow the first-resonant-mode signals in which the magnetic fields direct along the length of the slits to pass through the slits. Since the first and second conductor loop portions are coupled to the second resonant mode of the two dielectric resonators, the coupling amount of the second resonant mode between the two dielectric resonators via the conductor loop can be determined. Accordingly, the coupling amount of the second resonant mode can be varied by the conductor loop.

In this dielectric resonant device, the coupling of the second resonance mode between the two adjacent dielectric resonators, which is caused by a leakage of magnetic fields of the second resonant mode through the slits, may be canceled out by the coupling of magnetic fields of the second resonant mode of the two adjacent dielectric resonators to the first conductor loop portion and the second conductor loop portion.

With this structure, coupling is effected in the first resonant mode between the two dielectric resonators, and unwanted coupling of the second resonant mode can be suppressed, thereby obtaining a predetermined filter characteristic.

The present invention also provides a dielectric resonator device including: at least two adjacent dielectric resonators that resonate in at least first and second resonant modes; and a partitioning plate for partitioning the two adjacent dielectric resonators. In the two adjacent dielectric resonators, the surfaces formed by magnetic loops by the first and second resonant modes are orthogonal with each other. The partitioning plate is provided with slits, the magnetic loop of the first resonant mode of the two adjacent dielectric resonators passing along the length of the slits. The partitioning plate is also provided with a conductor loop including a first conductor loop portion coupled to the first resonant mode of one of the two adjacent dielectric resonators and a second conductor loop portion coupled to the second resonant mode of the other dielectric resonator.

The above-described slits allow the first-resonant-mode signals in which the magnetic fields direct along the length of the slits to pass through the slits. The first conductor loop portion is coupled to the first resonant mode of one of the two dielectric resonators, and the second conductor loop portion is coupled to the second resonant mode of the other dielectric resonator. Accordingly, when four-stage resonator portions are formed by two dielectric resonators, the first-stage and third-stage resonator portions can be jump-coupled via the conductor loop, or the second-stage and fourth-stage resonator portions can be jump-coupled via the conductor loop. Thus, the amount of jump coupling by skipping one resonator can be varied by this conductor loop.

In the dielectric resonator device of the present invention, the conductor loop may be provided for the partitioning plate such that it passes through one of the slits.

With this structure, the arrangement of the conductor loop is facilitated, and only by disposing the partitioning plate with the conductor loop at a predetermined position in the cavity, the two dielectric resonators can be coupled.

In the dielectric resonator device of the present invention, slit gaps may be provided in parallel with the slits between the inward of a cavity surrounding the two adjacent dielectric resonators and the side portions of the partitioning plate.

With this arrangement, since the slit gaps serve as slits, the electrical connection between the side portions of the partitioning plate and the inward of the cavity becomes unnecessary.

The present invention further provides a communication filter including: the above-described dielectric resonator device; and an external coupling unit which is externally coupled to the dielectric resonator device. In this communication filter, a bandpass characteristic exhibiting a large attenuation in the stop band can be obtained.

The present invention also provides a communication unit for a mobile communication base station, including the above-described communication filter in a high frequency circuit that allows a predetermined band of a communication signal to pass through. Accordingly, a small and inexpensive communication unit can be provided.

DESCRIPTION OF THE PREFERRED EMBODIMENTS

The present invention is described in detail below with reference to the accompanying drawings through illustration of preferred embodiments.

A dielectric resonator and a communication filter provided with the dielectric resonator constructed in accordance with a first embodiment of the present invention are described below with reference to FIGS. 1A–1D, 2A–2B, 3A–3B, 4A–4B, 5A–5B and 6–9.

Figure 1A:
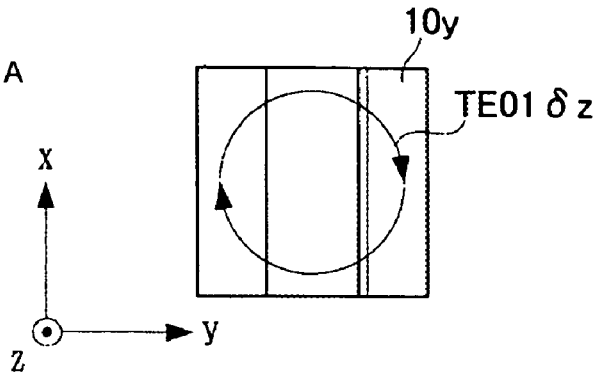
FIGS. 1A through 1D illustrate the structure of a dielectric core used in a dielectric resonator device according to a first embodiment of the present invention.
Figure 1B:
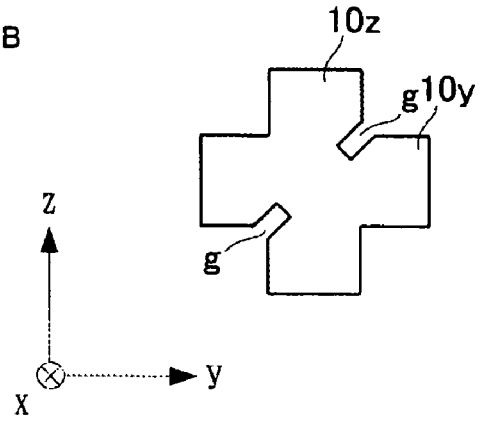
Figure 1C:
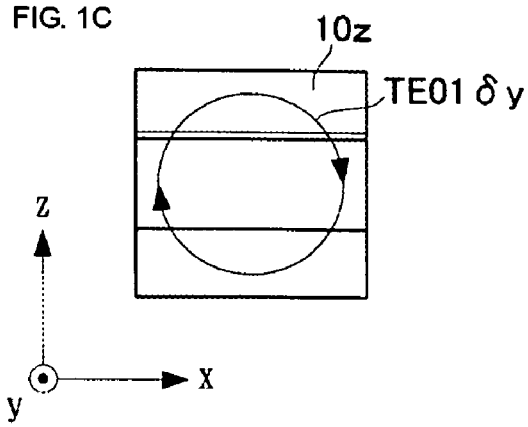
Figure 1D:
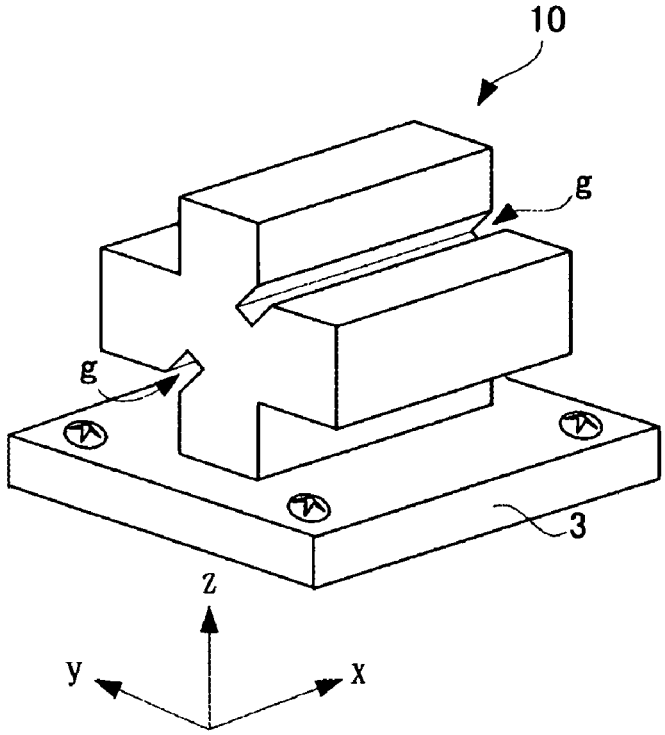

FIGS. 1A–1D illustrate the configuration of the dielectric resonator of the first embodiment. More specifically, FIGS. 1A, 1B, and 1C are a top view, a front view, and a right-side view, respectively, of a dielectric core 10, and FIG. 1D is a perspective view of the overall dielectric resonator. In FIG. 1D, the dielectric core 10 is configured by intersecting two rectangular parallelepipeds and integrating them and has a cross shape in section. Grooves g are preferably provided at the portions at which the two rectangular parallelepipeds intersect with each other. The dielectric core 10 is bonded to a support plate 3 by an adhesive or by glass grazing, for example.

As shown in FIG. 1A, a resonant mode, which is the TE01δz resonant mode in which an electric field on the plane (x-y plane) perpendicular to the z axis is circulated, is generated in a rectangular portion indicated by 10*y* of the dielectric core 10. Also, as shown in FIG. 1C, a resonant mode, which is the TE01δy resonant mode in which an electric field on the plane (x-z plane) perpendicular to the y axis is circulated, is generated in a rectangular portion indicated by 10*z* of the dielectric core 10.

Figure 2A:
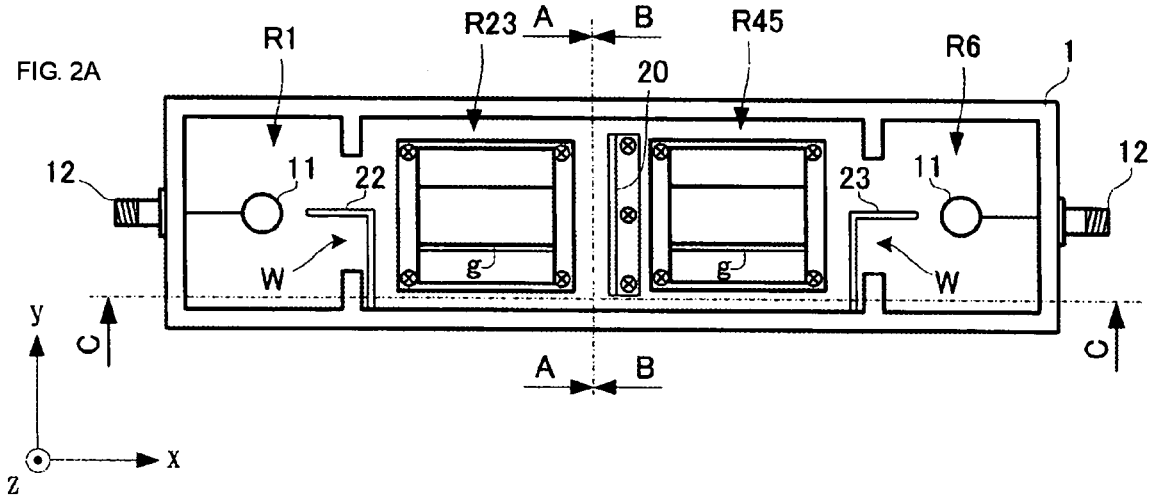
FIGS. 2A and 2B illustrate the configuration of a communication filter using the dielectric resonator devices shown in FIGS. 1A through 1D.
Figure 2B:
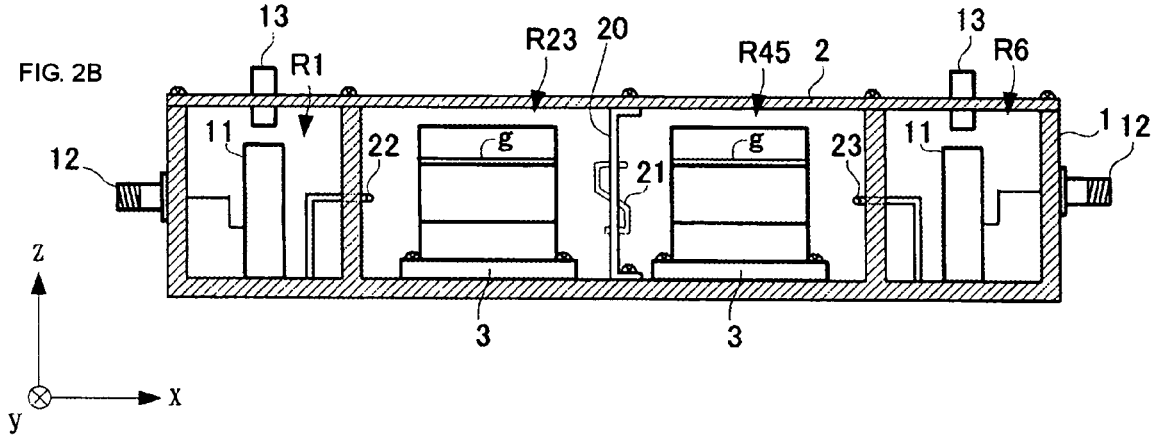

FIGS. 2A–2B illustrate the configuration of a communication filter provided with the dielectric resonator shown in FIGS. 1A through 1D. More specifically, FIG. 2A is a top view illustrating the communication filter from which a cavity cover 2 at the top is removed, and FIG. 2B is a vertically sectional view illustrating the communication filter along line C—C of FIG. 2A provided with the cavity cover 2. Resonators R1, R23, R45, and R6 are disposed within a cavity chamber formed by a cavity unit 1 and the cavity cover 2. As the resonators R23 and R45, the dielectric cores 10 with the support plate 3 shown in FIG. 1D are used. Three or more dielectric resonators may be used.

The resonators R1 and R6 each form a semi-coaxial resonator. More specifically, a central conductor 11 having a predetermined height is disposed from the bottom of the cavity chamber of the cavity unit 1. Coaxial connectors 12 are fixed to the outer surfaces of the cavity unit 1, and the central conductor of the coaxial connector 12 is connected to the corresponding central connector 11. A frequency regulating screw 13 is fixed at part of the cavity cover 2 facing the top of the central conductor 11. By adjusting a stray capacitance generated between the frequency regulating screw 13 and the top of the central conductor 11, the resonant frequency of the semi-coaxial resonator can be regulated.

A window W is disposed between the resonators R1 and R23 and between the resonators R6 and R45. A partitioning plate 20 is disposed between the resonators R23 and R45. A jump-coupling conductor loop 22 is provided between the resonators R1 and R23, and a jump-coupling conductor loop 23 is also provided between the resonators R45 and R6.

Figure 3A:
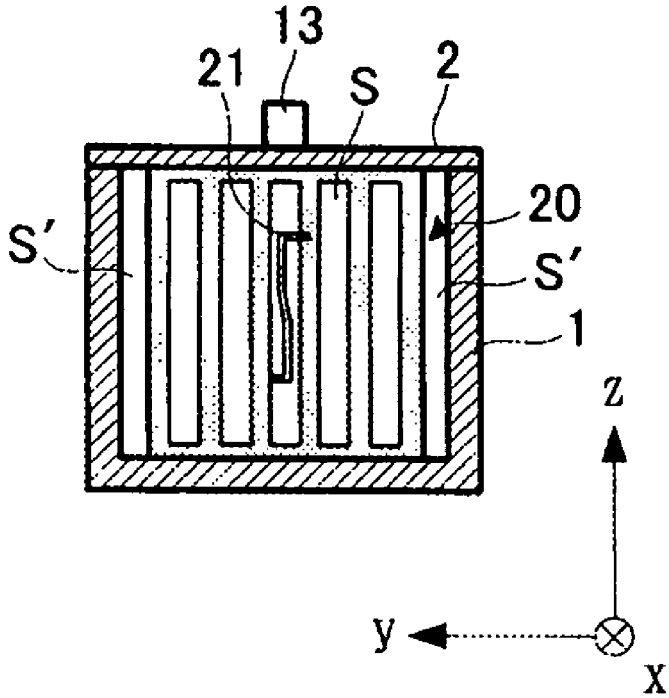
FIGS. 3A and 3B are sectional views taken along line A—A and line B—B, respectively, of FIG. 2A.
Figure 3B:
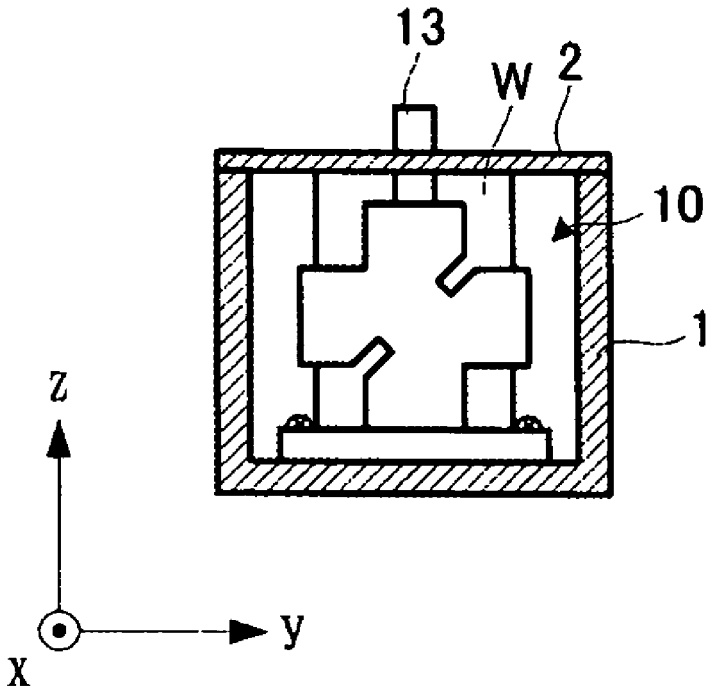

FIG. 3A is a sectional view along line A—A of FIG. 2A, and FIG. 3B is a sectional view along line B—B of FIG. 2A.

As shown in FIG. 3A, a plurality of slits S are formed in the partitioning plate 20. A conductor loop 21 is provided for the partitioning plate 20. Slit gaps S' are also provided in parallel with the slits S between the side surfaces of the partitioning plate 20 and the cavity chamber.

Since the length of the slits S of the partitioning plate 20 is in parallel with the z axis, magnetic coupling of the TE01δz mode generated in the resonators R23 and the resonator R45 is conducted.

Figure 4A:
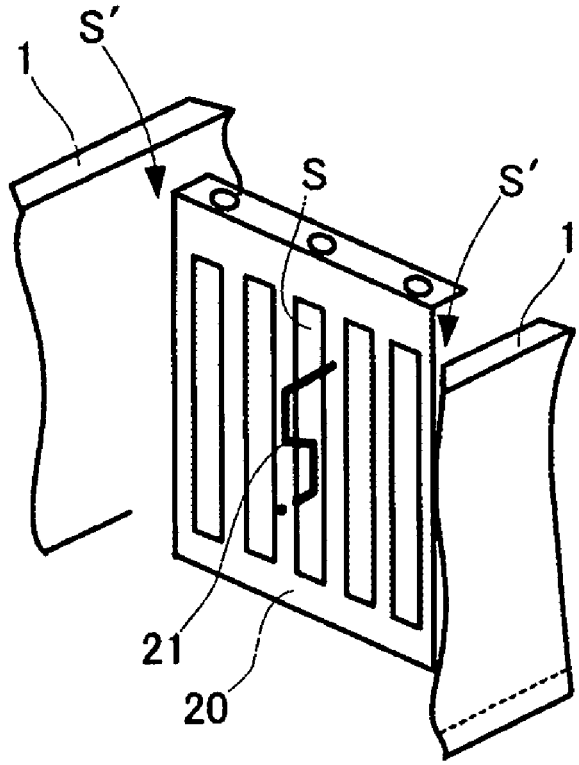
FIGS. 4A and 4B illustrate the structure of a partitioning plate shown in FIGS. 2A and 2B.
Figure 4B:
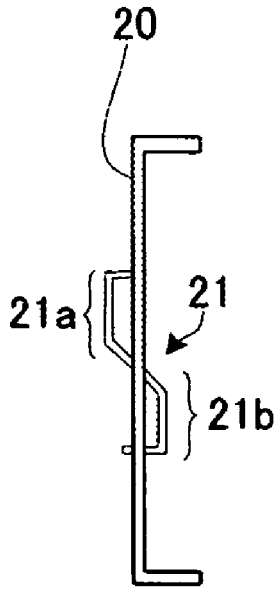

FIGS. 4A and 4B are a perspective view and a side view, respectively, illustrating the partitioning plate 20. In the perspective view of FIG. 4A, for the simplicity of the drawing, the thickness of the partitioning plate 20 is indicated by one line (the same applies to the subsequent perspective views).

The conductor loop 21 consists of a first conductor loop portion 21*a* and a second conductor loop portion 21*b*. The first and second conductor loop portions 21*a* and 21*b* form a loop surface linked to magnetic fields directing orthogonal to the length of the slits S (i.e., magnetic fields along the width of the slits S). The first conductor loop portion 21*a* is exposed to the proximal side of FIG. 4A, i.e., to the left side of the resonator in FIG. 4B, while the second conductor loop portion 21*b* is exposed to the distal side of FIG. 4A, i.e., to the right side of the resonator in FIG. 4B.

The slit gaps S' formed between the partitioning plate 20 and the cavity chamber of the cavity unit 1 shown in FIGS. 3A and 4A function in a manner similar to the slits S. Accordingly, the electrical connection between the sides of the partitioning plate 20 and the cavity chamber of the cavity unit 1 becomes unnecessary. According to the structure of a known filter without the slit gaps S', the electrical connection of the above-described portion must be established sufficiently smoothly with respect to high-frequency currents. If the electrical connection is insufficient, the Q factor of the resonator is decreased so as to increase insertion loss. In this embodiment, however, such a problem can be solved by the provision of the slit gaps S'. When forming a duplexer by integrally providing a transmission filter and a reception filter in known art, it is structurally difficult to electrically connect all the four side surfaces of a partitioning plate to the cavity chamber of one filter because of the presence of a space of the other filter across the cavity wall. Instead of using screws, a partitioning plate may be disposed by pressing, in which case, however, electrical connection may become insufficient. Alternatively, reflow soldering may be used to fix a partitioning plate to the cavity chamber, in which case, however, the process becomes complicated and thus increases the cost. Such problems can be solved by the structure provided with the slit gaps S' shown FIGS. 3A and 4A.

Figure 5A:
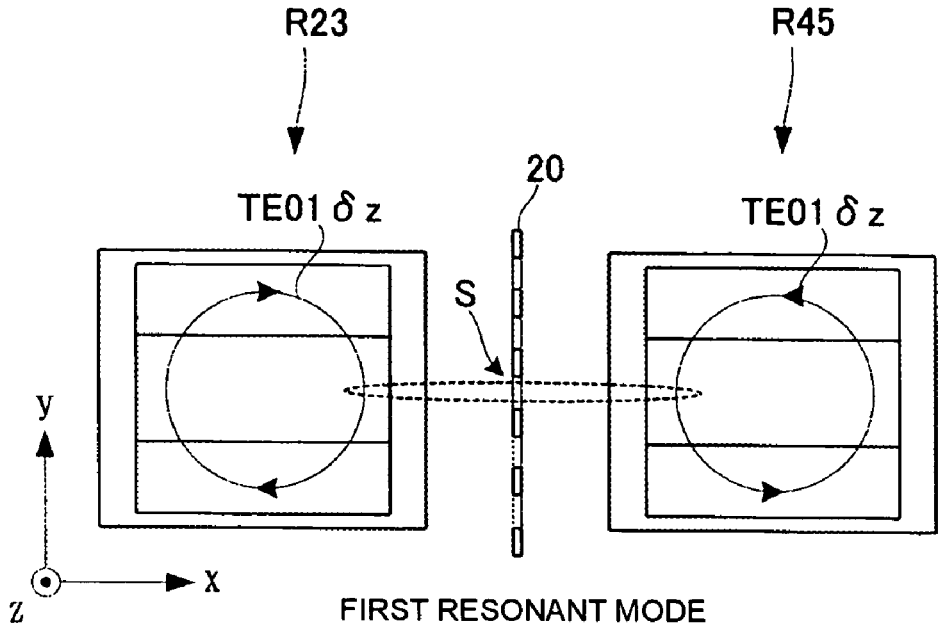
FIGS. 5A and 5B illustrate coupling states of two dielectric resonators disposed across the partitioning plate.
Figure 5B:
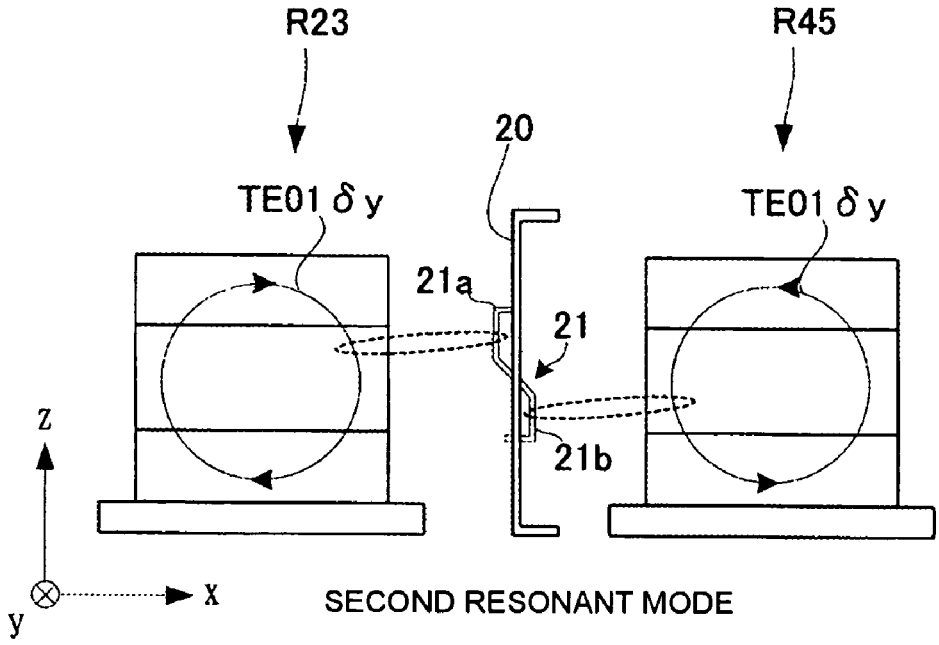

FIG. 5A illustrates the coupling state of the first resonant mode generated in the two resonators R23 and R45 shown in FIGS. 2A and 2B via the partitioning plate 20. FIG. 5B illustrates the coupling state of second resonant modes generated in the two resonators R23 and R45 via the partitioning plate 20. As shown in FIG. 5A, the first resonant modes (TE01δz mode) of the resonators R23 and R45 are coupled to each other since the magnetic fields of the first resonant modes longitudinally pass through the slits S of the partitioning plate 20. As shown in FIG. 5B, the magnetic fields of the second resonant mode (TE01δy mode) of the resonator R23 are coupled to the first conductor loop portion 21 a, while the magnetic fields of the second resonant mode (TE01δy mode) of the resonator R45 are coupled to the second conductor loop portion 21*b*. Accordingly, the amount by which the second resonant modes are coupled can be determined by the conductor loop 21.

Figure 6:
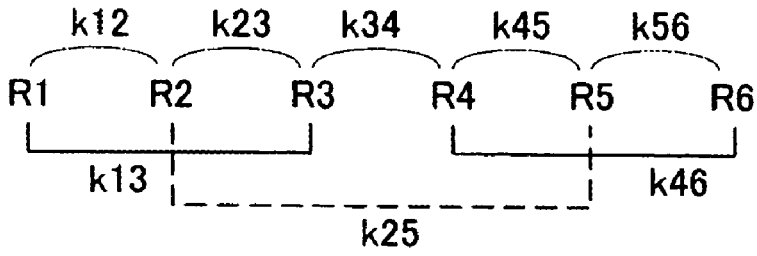
FIG. 6 illustrates the coupling relationship of the dielectric resonators used in the communication filter shown in FIGS. 2A and 2B.

FIG. 6 illustrates the coupling relationship between the resonators of the communication filter shown in FIGS. 2A and 2B. R2 indicates a TE01δy-mode resonator portion of the resonator R23, and R3 indicates a TE01δz-mode resonator portion of the resonator R23, R4 designates a TE01δz-mode resonator portion of the resonator R45, and R5 designates a TE01δy-mode resonator portion of the resonator R45. Coupling k12 between the resonators R1 and R2 is due to spatial magnetic coupling, while coupling k56 between the resonators R5 and R6 is also due to spatial magnetic coupling. Coupling k23 between the resonators R2 and R3 is due to the grooves g formed in the resonator R23, while coupling k45 between the resonators R4 and R5 is also due to the grooves g formed in the resonator R45.

Coupling k34 between the resonators R3 and R4 is due to magnetic fields passing through the slits S formed in the partitioning plate 20. Coupling k13 between the resonators R1 and R3 is due to the jump-coupling conductor loop 22, while coupling k46 between the resonators R4 and R6 is also due to the jump-coupling conductor loop 23.

Coupling k25 between the resonators R2 and R5 is due to a synergetic effect of the coupling of the magnetic fields leaked from the slits S formed in the partitioning plate 20 and the coupling of the magnetic fields by the provision of the conductor loop 21. More specifically, although most of the magnetic fields of the TE01δy mode of the resonators R23 and R45 are shielded since they are oriented along the width of the slits S, a slight leakage of the magnetic fields occurs, thereby causing coupling of such magnetic fields. In the first embodiment, the conductor loop 21 is formed in an S or an inverted S shape, i.e., the first and second conductor loop portions 21*a* and 21*b* are twisted. Accordingly, the orientations of the magnetic fields linked to the conductor loop 21 in the two spaces across the partitioning plate 20 become opposite to each other. Thus, the coupling of a leakage of magnetic fields from the slits S can be canceled out.

In the example shown in FIGS. 2A and 2B, since the grooves g are formed in the same direction between the resonators R23 and R45, the polarity of the coupling coefficient of coupling k25 of the magnetic fields between the resonators R2 and R5 that are leaked from the slits S becomes the same as the coupling coefficient of coupling k34 between the resonators R3 and R4. Accordingly, when the loop area of the first and second conductor loop portions

21*a* and 21*b* of the conductor loop 21 is increased to a certain degree, the coupling of magnetic fields leaked from the slits S is canceled out, and the coupling coefficient of coupling k25 becomes 0. When the loop area of the first and second conductor loop portions 21*a* and 21*b* is further increased, the polarity of coupling k25 becomes opposite to the polarity of coupling k34, and jump coupling occurs between the resonators R2 and R5.

Figure 7:
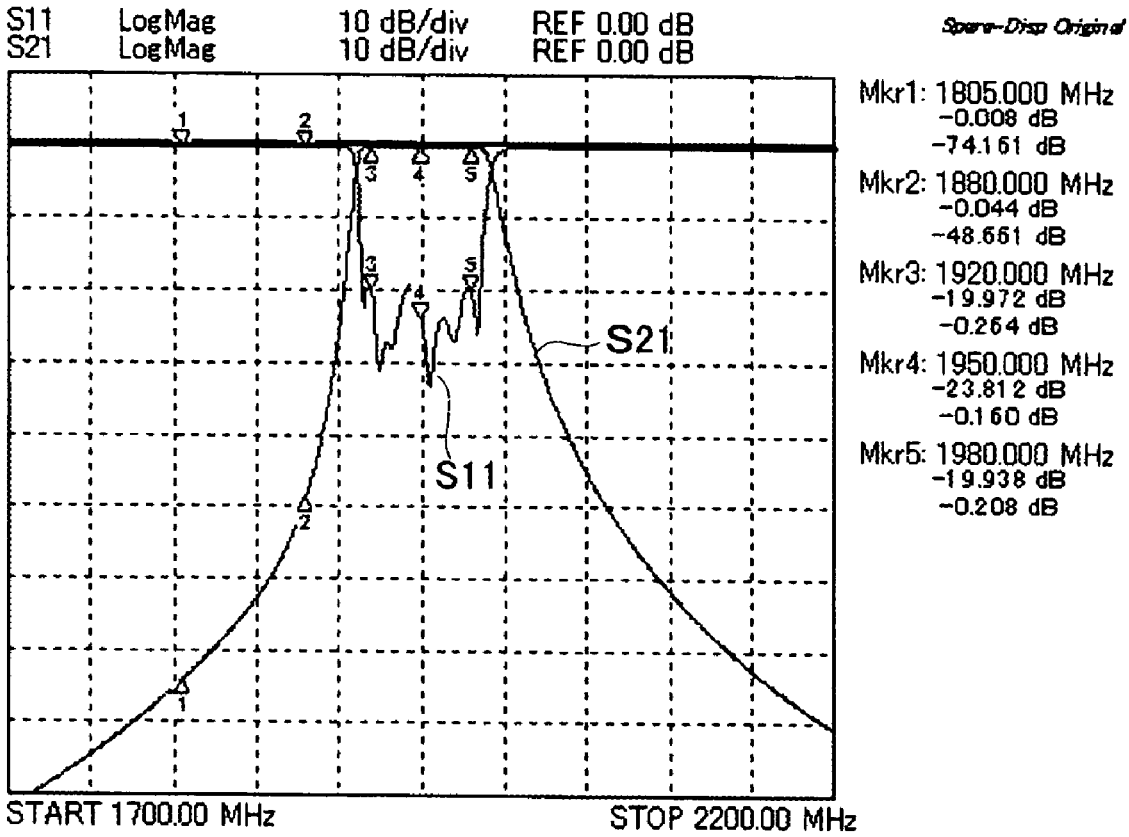
FIG. 7 is a characteristic diagram in which unwanted jump coupling occurs.
Figure 8:
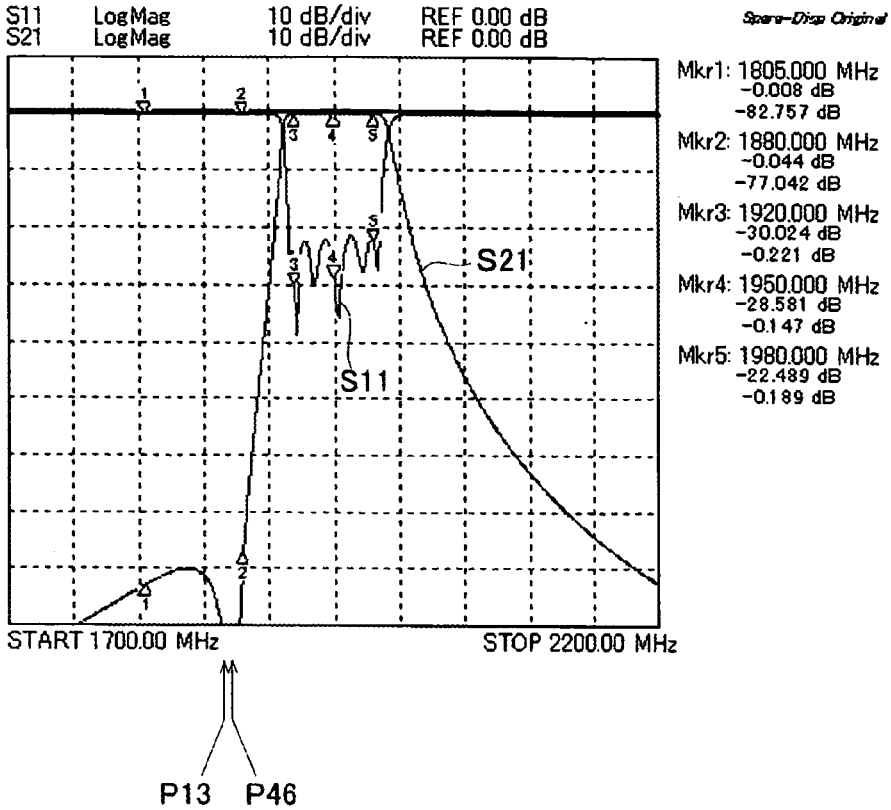
FIG. 8 is a characteristic diagram in which unwanted jump coupling is canceled out.
Figure 9:
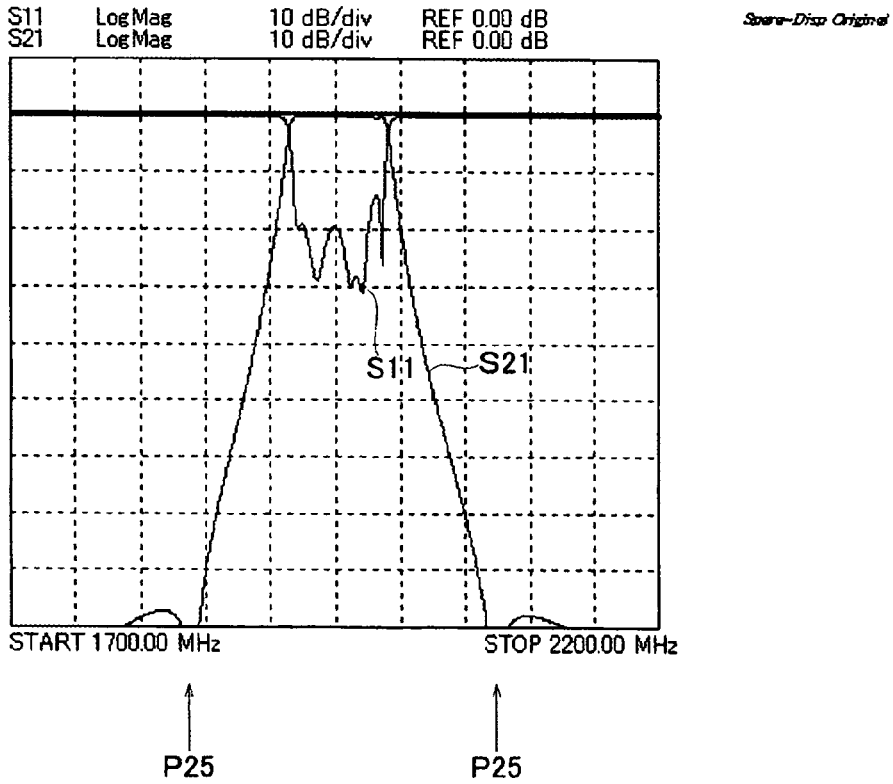
FIG. 9 is a characteristic diagram in which jump coupling having the polarity opposite to the polarity of another coupling occurs.

FIGS. 7, 8, and 9 are diagrams illustrating bandpass characteristic (S21) and reflection characteristic (S11) when the coupling coefficient of coupling k25 is varied. In the diagrams, the vertical axis represents the attenuation indicated in decibels in increments of 10 dB, the position indicated by the solid line being 0 dB. The horizontal axis designates the frequency indicated by a linear scale from 1700 to 2200 MHz.

FIG. 7 illustrates the characteristics when the coupling coefficient of jump coupling k25 of magnetic fields that are naturally leaked from the slits S is +0.08% (the same polarity as coupling k34) without providing the conductor loop 21. One of the requirements for the characteristics of the communication filter of this embodiment is to implement the attenuation of 75 dB or greater between marker 1 and marker 2 indicated by triangles in FIG. 7. To satisfy this requirement, jump coupling having a negative coupling coefficient indicated by k13 and k46 is generated. However, due to the influence of jump coupling k25 having a positive coupling coefficient, no attenuation pole is generated between marker 1 and marker 2. Thus, it has been proved that the provision of a partitioning plate with slits only does not achieve the attenuation of 75 dB or greater.

FIG. 8 illustrates the characteristics when the coupling coefficient of coupling k25 is almost 0% by adjusting the loop area of the first and second conductor loop portions 21*a* and 21*b*. Accordingly, an attenuation pole due to jump coupling k13 and k46 is generated between marker 1 and marker 2, thereby implementing the attenuation of 75 dB or greater. In FIG. 8, P13 and P46 indicate the positions of the attenuation pole due to jump coupling k13 and k46, respectively.

FIG. 9 illustrates the characteristics when the coupling coefficient of coupling k25 is −0.05% by increasing the loop area of the first and second conductor loop portions 21*a* and 21*b* without providing the jump-coupling conductor loops 22 and 23. In this manner, when jump coupling having the polarity opposite to that of coupling k34 takes place by skipping even-numbered resonators, an attenuation pole is generated both in the higher frequency range and the lower frequency range of the pass band. In FIG. 9, P25 indicates the attenuation poles generated due to jump coupling k25.

The configuration of the main portions of a dielectric resonator device constructed in accordance with a second embodiment of the present invention is described below with reference to FIGS. 10A, 10B, and 10C.

Figure 10A:
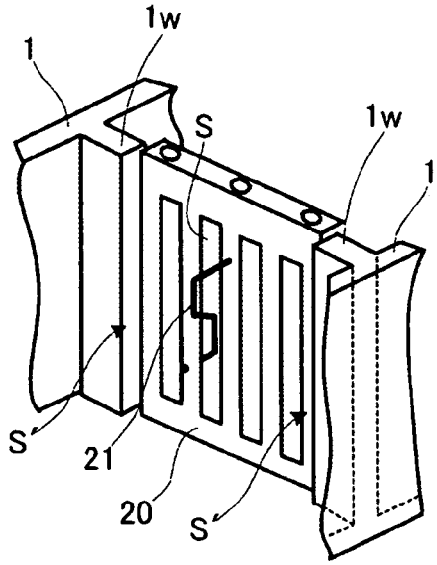
FIGS. 10A, 10B, and 10C illustrate the structure of a partitioning plate and adjacent portions of a dielectric resonator device according to a second embodiment of the present invention.
Figure 10B:
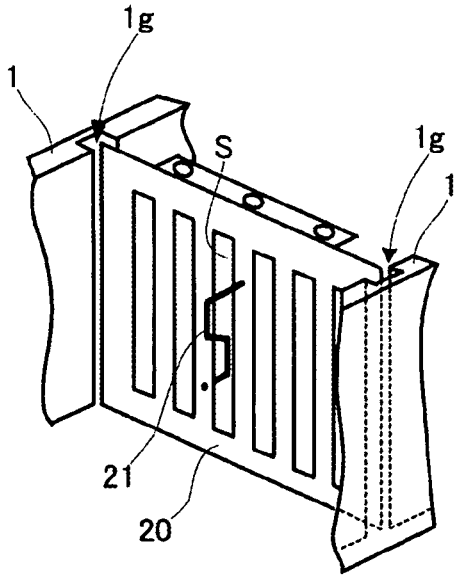
Figure 10C:
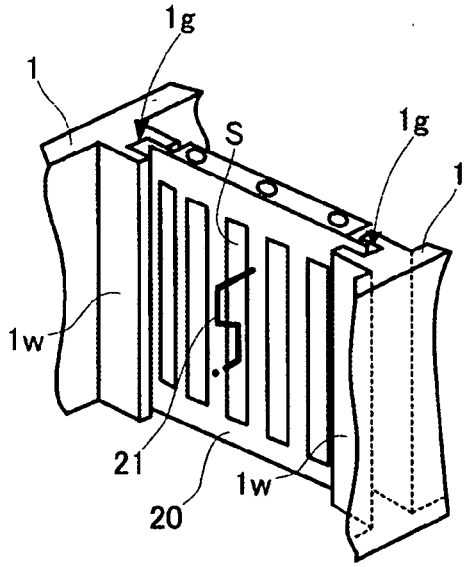

FIGS. 10A, 10B, and 10C illustrate examples of the structure of a partitioning plate 20 and the cavity unit 1 adjacent to the partitioning plate 20. In the example shown in FIG. 10A, projections 1*w* exposed to the inwards of the cavity unit 1 are provided, and the partitioning plate 20 is disposed between the projections 1*w*. Slit gaps S' are also provided between the partitioning plate 20 and the projections 1*w*. With this structure, the required number of slits can be decreased compared to the other structures of the partitioning plate 20.

In the example shown in FIG. 10B, recessed portions 1*g* are provided in parallel with the slits S between the side portions of the partitioning plate 20 and the cavity chamber of the cavity unit 1 so that the side portions of the partitioning plate 20 are inserted into the recessed portions 1*g*. With this structure, the recessed portions 1*g* can be used as slit gaps.

In the example shown in FIG. 10C, projections 1*w* are provided in the cavity chamber of the cavity unit 1, and also, recessed portions 1*g* are formed in the projections 1*w* so that the side portions of the partitioning plate 20 are inserted into the recessed portions 1*g* with gaps. With this structure, a predetermined number of slits can be provided, and also, the recessed portions g can be used as slit gaps.

Figure 11A:
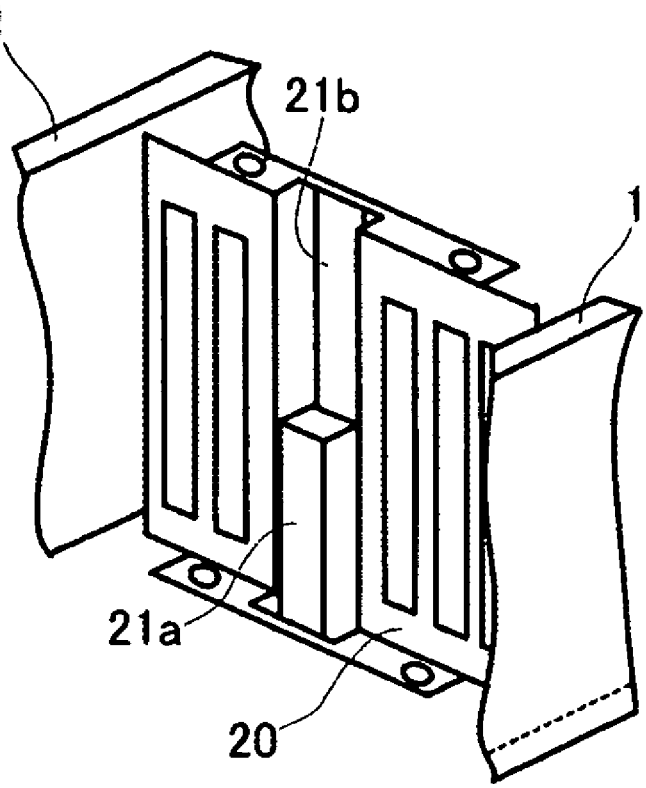
FIGS. 11A and 11B illustrate the structure of a partitioning plate and adjacent portions of a dielectric resonator device according to a third embodiment of the present invention.
Figure 11B:
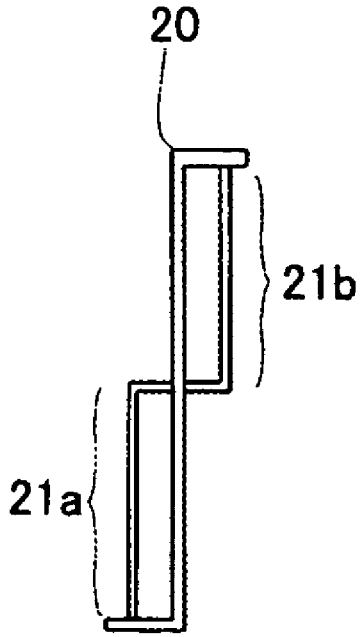

FIGS. 11A and 11B illustrate the configuration of the main portions of a dielectric resonator device constructed in accordance with a third embodiment of the present invention. More specifically, FIGS. 11A and 11B are a perspective view and a side view, respectively, of a partitioning plate 20. In this embodiment, first and second conductor loop portions 21*a* and 21*b* are continuously and integrally formed with the partitioning plate 20. The loop area of the first and second conductor loop portions 21*a* and 21*b* can be indicated by the area when viewed from the side portions of the first and second conductor loop portions 21*a* and 21*b*.

Figure 12A:
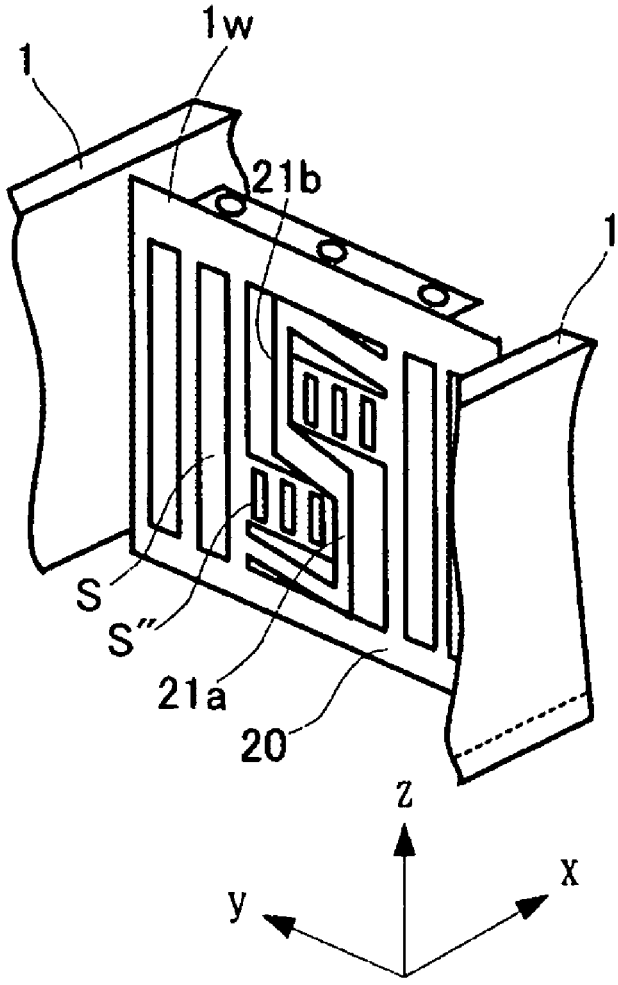
FIGS. 12A and 12B illustrate the structure of a partitioning plate and adjacent portions of a dielectric resonator device according to a fourth embodiment of the present invention.
Figure 12B:
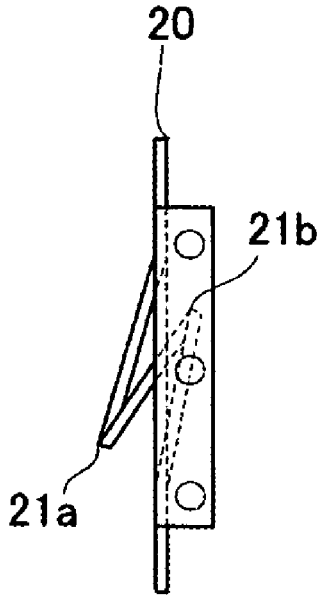

FIGS. 12A and 12B illustrate the configuration of the main portions of a dielectric resonator device constructed in accordance with a fourth embodiment of the present invention. More specifically, FIGS. 12A and 12B are a perspective view and a top view, respectively, of a partitioning plate 20 and the surrounding portions. In this embodiment, first and second conductor loop portions 21*a* and 21*b* are formed so that the conductor loop 21 forms an S shape or an inverted S shape when the partitioning plate 20 is viewed in the x axis, and forms an N shape or an inverted N shape when the partitioning plate 20 is viewed in the z axis. In the remaining portions of the conductor loop 21 after punching and raising the first and second conductor loop portions 21*a* and 21*b*, slits S", which also serve as slits S, are formed.

Figure 13:
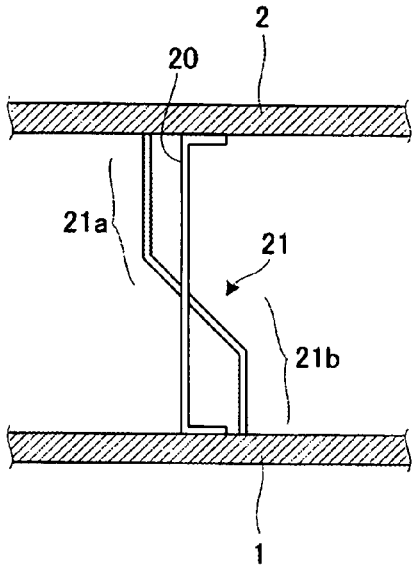
FIG. 13 illustrates the structure of a partitioning plate and adjacent portions of a dielectric resonator device according to a fifth embodiment of the present invention.

FIG. 13 is a side view illustrating the structure of a partitioning plate 20 of a dielectric resonator device constructed in accordance with a fifth embodiment of the present invention. The structure of this partitioning plate 20 is similar to that shown in FIGS. 4A and 4B, except that the conductor loop 21 is separately provided from the partitioning plate 20. In this embodiment shown in FIG. 13, the conductor loop 21 having the first and second conductor loop portions 21*a* and 21*b* is fixed to the cavity unit 1 and the cavity cover 2. The conductor loop 21 is disposed through the central slit or the adjacent slit provided in the partitioning plate 20 so that it can prevent from contacting the partitioning plate 20. With this structure, the loop area can also be determined by the first and second conductor loop portions 21*a* and 21*b* and the partitioning plate 20.

A communication filter constructed in accordance with a sixth embodiment of the present invention is described below with reference to FIGS. 14A through 15B.

The communication filter of this embodiment is different from that shown in FIGS. 2A and 2B in that an untwisted conductor loop 21 is provided for the partitioning plate 20, the direction of grooves g formed in the resonator R23 is opposite to that of grooves g formed in the resonator R45, and the jump-coupling conductor loops 22 and 23 are not provided. The other aspects of the structure are similar to those shown in FIGS. 2A and 2B.

The grooves g formed in the resonator R23 are slanted upwards to the right side at 45° as viewed along the x axis, while the grooves g formed in the resonator R45 are slanted upwards to the left side at 45° as viewed along the x axis. With this relationship of the grooves g between the resonators R23 and R45, the polarity of the coupling coefficient of coupling k25 of the magnetic fields that are leaked from the slits S of the partitioning plate 20 becomes opposite to that of coupling k34.

Figure 14A:
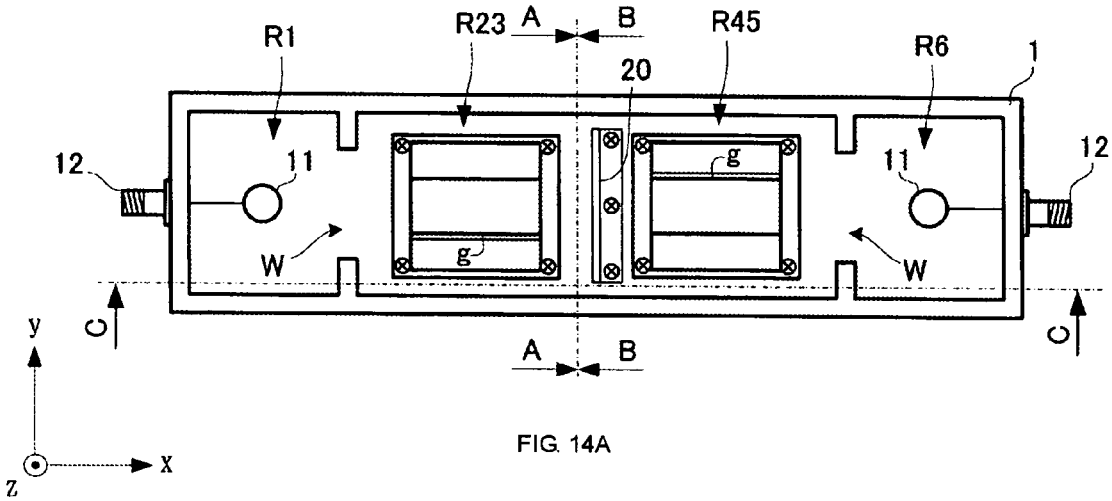
FIGS. 14A and 14B illustrate the structure of a communication filter according to a sixth embodiment of the present invention.
Figure 14B:
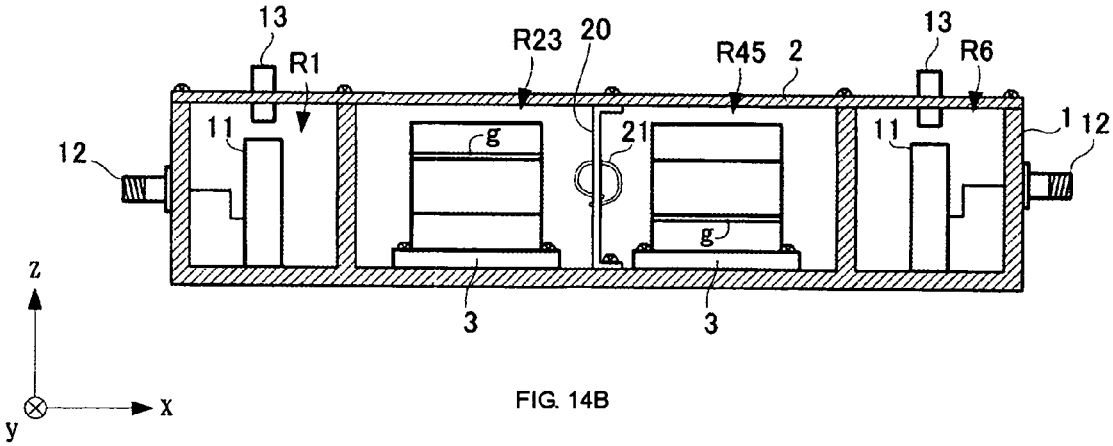
Figure 15A:
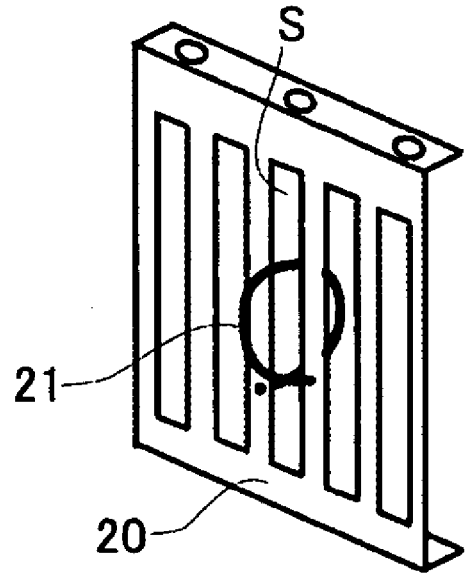
FIGS. 15A and 15B illustrate the partitioning plate and adjacent portions of the communication filter shown in FIGS. 14A and 14B.
Figure 15B:
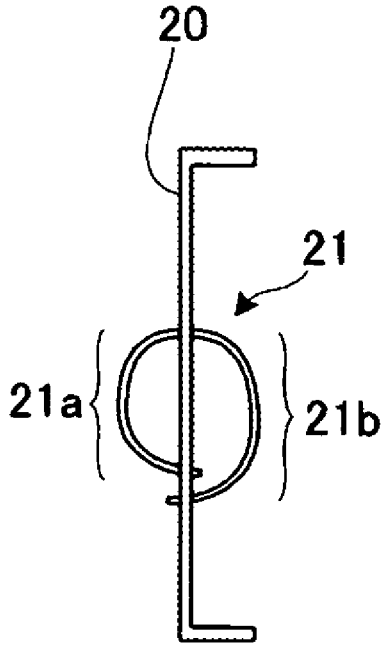

FIGS. 15A and 15B illustrate the structure of the partitioning plate 20 shown in FIGS. 14A and 14B and the conductor loop 21 provided for this partitioning plate 20. The conductor loop 21 is constructed such that both ends thereof are connected to the partitioning plate 20 and the first and second conductor loop portions 21*a* and 21*b* are exposed to the front and back sides of the partitioning plate 20 so as to form, as a whole, one turn of a loop. By providing the untwisted conductor loop 21, the absolute value of the coupling coefficient of jump coupling k25 becomes larger while the polarity thereof being opposite to that of the coupling coefficient of coupling k34. The coupling coefficient of jump coupling k25 is set to be a predetermined value by adjusting the loop area of the first and second conductor loop portions 21*a* and 21*b*, thereby obtaining a characteristic, similar to that shown in FIG. 9, having attenuation poles P25, P25 generated by jump coupling k25 in the higher range and the lower range of the pass band.

Figure 16:
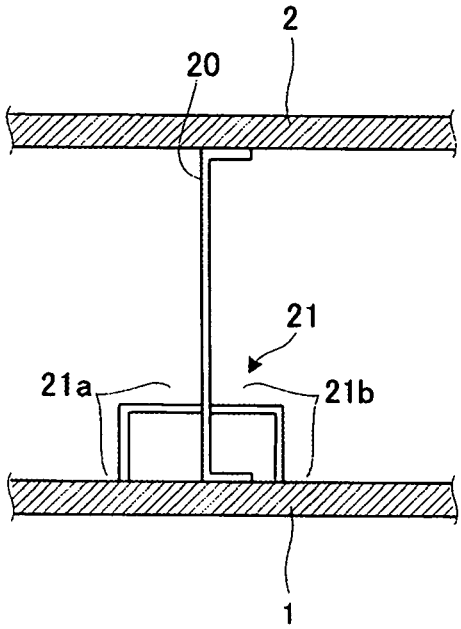
FIG. 16 illustrates the structure of a partitioning plate and adjacent portions of a dielectric resonator device according to a seventh embodiment of the present invention.

FIG. 16 illustrates the structure of a partitioning plate 20 of a communication filter constructed in accordance with a seventh embodiment of the present invention. In this embodiment, a conductor loop 21 passes through a slit of the partitioning plate 20 so that ends thereof are connected to the bottom of the cavity unit 1. With this structure, conductor loop portions exposed to the front and back sides of the partitioning plate 20 serve as the first and second conductor loop portions 21*a* and 21*b*. In this manner, an untwisted conductor loop may be separately disposed from the partitioning plate 20.

In the first and sixth embodiments shown in FIGS. 2A and 2B and FIGS. 14A and 14B, respectively, the coupling coefficient of jump coupling k25 is set to be 0 or the predetermined value such that the polarity thereof becomes opposite to that of coupling k34. However, the coupling coefficient of jump coupling k25 may be set to be the predetermined value while the polarity thereof remains the same as that of coupling k34. For example, in the embodiment shown in FIGS. 2A and 2B, the conductor loop 21 may be substituted by an untwisted conductor loop, such as that shown in FIG. 15A or 16. Alternatively, the conductor loop 21 shown in FIGS. 14A and 14B may be substituted by a twisted conductor loop, such as that shown in FIGS. 2A and 2B. By setting the polarity of the coupling coefficient of jump coupling k25 to be the same as that of coupling k34, the group delay characteristic in the pass band can be considerably improved, though the attenuation characteristics of the higher range and the lower range of the pass band are deteriorated.

Figure 17:
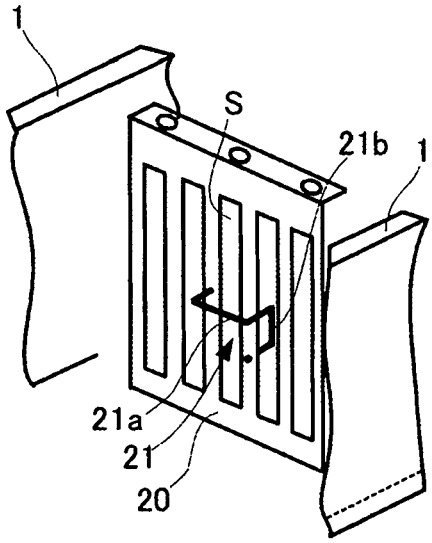
FIG. 17 illustrates the structure of a partitioning plate and adjacent portions of a dielectric resonator device according to an eighth embodiment of the present invention.

FIG. 17 is a perspective view illustrating the structure of the main portions of a dielectric resonator device constructed in accordance with an eighth embodiment of the present invention. Also in this embodiment, a conductor loop 21 consisting of a first conductor loop portion 21*a* and a second conductor loop portion 21*b* are provided for the partitioning plate 20. Unlike the conductor loop 21 shown in FIGS. 4A and 4B, however, the first conductor loop portion 21 a has a substantially horizontal loop surface, while the second conductor loop portion 21*b* has a substantially vertical loop surface. Accordingly, if the partitioning plate 20 shown in FIGS. 2A and 2B is substituted by the partitioning plate 20 shown in FIG. 17, the first conductor loop portion 21*a* is coupled to TE01δz-mode magnetic fields of the resonator R23, while the second conductor loop portion 21*b* is coupled to TE01δy-mode magnetic fields of the resonator R45. Since the TE01δz-mode resonator R23 corresponds to the third-stage resonator R3 shown in FIG. 6, and the TE01δy-mode resonator R45 corresponds to the fifth-stage resonator R5 shown in FIG. 6, the conductor loop 21 serves the function of jump-coupling the third-stage resonator R3 and the fifth-stage resonator R5 by skipping one resonator, i.e., the fourth-stage resonator R4. When the polarity of jump coupling between the resonators R3 and R5 is the same as coupling k34, an attenuation pole is generated in the higher range of the pass band. When the polarity is different from that of coupling k34, an attenuation pole is generated in the lower range of the pass band.

As described above, an attenuation pole can be generated by skipping odd-numbered resonators, for example, one resonator.

In the foregoing embodiments, both the first and second resonant modes are TE01δ modes. However, one of or both the first and second resonant modes may be TM modes. For example, in the embodiment shown in FIGS. 2A and 2B, a TM-multiple-mode dielectric resonator device may be constructed in which resonance produces in the TM110z mode or TM11δz mode having electric fields orienting in the z axis and in the TM110y mode or TM11δy mode having electric fields orienting in the y axis.

Figure 18:
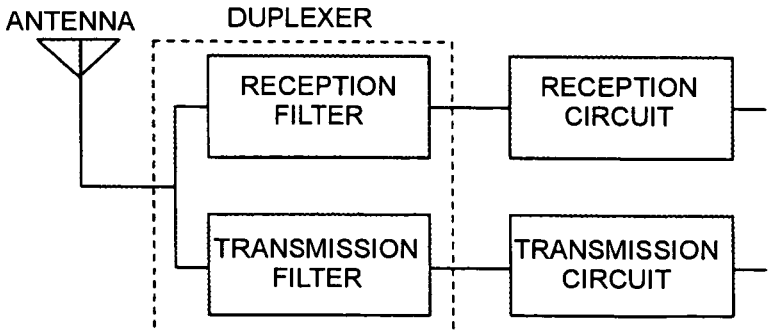
FIG. 18 illustrates the configuration of a communication unit for a mobile communication base station according to a ninth embodiment of the present invention.

The configuration of a communication unit for a mobile communication base station constructed in accordance with a ninth embodiment of the present invention is shown in FIG. 18.

In this communication unit, a duplexer is formed of a transmission filter and a reception filter, each of which is the communication filter of one of the above-described embodiments. Phase adjustments are conducted between the output port of the transmission filter and the input port of the reception filter so that a transmission signal can be prevented from entering the reception filter and a reception signal can be prevented from entering the transmission filter. A transmission circuit is connected to the input port of the transmission filter, and a reception circuit is connected to the output port of the reception filter. An antenna is connected to an antenna port. With this configuration, a communication unit provided with the dielectric resonator device of the present invention can be formed.

What is claimed is:

1. A dielectric resonator device comprising:

at least two adjacent dielectric resonators that each resonate in at least a first and a second resonant mode, said first resonant mode and said second resonant mode having respective magnetic loops which are orthogonal with respect to each other;

a partitioning plate located between said at least two adjacent dielectric resonators, said partitioning plate including slits, said magnetic loop of said first resonant mode of said at least two adjacent dielectric resonators passing along a length of the slits; and a conductor loop provided with said partitioning plate, said conductor loop including a first conductor loop portion coupled to said second resonant mode of a first dielectric resonator of said at least two adjacent dielectric resonators and a second conductor loop portion coupled to said second resonant mode of a second dielectric resonator of said at least two adjacent dielectric resonators.

2. The dielectric resonator device according to claim 1, wherein said conductor loop is disposed such that it passes through one of said slits.

3. The dielectric resonator device according claim 1, further comprising:

a wall surrounding said at least two adjacent dielectric resonators and forming a cavity; and slit gaps provided parallel to said slits, said slit gaps positioned between said wall of said cavity and side portions of said partitioning plate.

4. The dielectric resonator device according to claim 1, further comprising:

a wall surrounding said at least two adjacent dielectric resonators and forming a cavity; and a set of opposed projections extending from said wall into said cavity, said partitioning plate positioned between said set of opposed projections.

5. The dielectric resonator device according to claim 1, further comprising:

a wall surrounding said at least two adjacent dielectric resonators and forming a cavity; and a set of opposed recesses in said wall of said cavity, said partitioning plate positioned within said set of opposed recesses.

6. The dielectric resonator device according to claim 1, further comprising:

a wall surrounding said at least two adjacent dielectric resonators and forming a cavity;

a set of opposed projections extending from said wall into said cavity; and respective recess provided in each of said opposed projections, said partitioning plate positioned within said respective recesses.

7. The dielectric resonator device according to claim 1, wherein said first conductor loop portion and said second conductor loop portion are integrally formed with the partitioning plate.

8. A communication filter comprising:

the dielectric resonator device set forth in claim 1; and an external coupling unit which is externally coupled to the dielectric resonator device.

9. A communication unit for a mobile communication base station, the communication unit comprising:

a high frequency circuit that allows a predetermined band of a communication signal to pass through, the high frequency circuit including the communication filter set forth in claim 8.

10. The dielectric resonator device according to claim 1, wherein coupling of said second resonant mode between said at least two adjacent dielectric resonators caused by a leakage of magnetic fields of said second resonant mode through the slits is canceled out by coupling said magnetic fields of said second resonant mode of said at least two adjacent dielectric resonators through said first conductor loop portion and said second conductor loop portion.

11. The dielectric resonator device according to claim 10, wherein coupling of said second resonant mode between said at least two adjacent dielectric resonators caused by a leakage of said magnetic fields of the second resonant mode through the slits is canceled out by an arrangement of relative positions of said first conductor loop portion and said second conductor loop portion and an arrangement of relative positions of grooves provided in said at least two adjacent dielectric resonators.

12. A dielectric resonator device comprising:

at least two adjacent dielectric resonators that each resonate in at least a first and a second resonant mode, said first resonant mode and said second resonant mode having respective magnetic loops which are orthogonal with respect to each other;

a partitioning plate located between said at least two adjacent dielectric resonators, said partitioning plate including slits, said magnetic loop of said first resonant mode of said at least two adjacent dielectric resonators passing along a length of the slits; and a conductor loop provided with said partitioning plate, said conductor loop including a first conductor loop portion coupled to said first resonant mode of a first dielectric resonator of said at least two adjacent dielectric resonators and a second conductor loop portion coupled to said second resonant mode of a second dielectric resonator of said at least two adjacent dielectric resonators.

13. The dielectric resonator device according to claim 12, wherein said conductor loop is disposed such that it passes through one of said slits.

14. The dielectric resonator device according claim 12, further comprising:

a wall surrounding said at least two adjacent dielectric resonators and forming a cavity; and slit gaps provided parallel to said slits, said slit gaps positioned between said wall of said cavity and side portions of said partitioning plate.

15. The dielectric resonator device according to claim 12, further comprising:

a wall surrounding said at least two adjacent dielectric resonators and forming a cavity; and a set of opposed projections extending from said wall into said cavity, said partitioning plate positioned between said set of opposed projections.

16. The dielectric resonator device according to claim 12, further comprising:

a wall surrounding said at least two adjacent dielectric resonators and forming a cavity; and a set of opposed recesses in said wall of said cavity, said partitioning plate positioned within said set of opposed recesses.

17. The dielectric resonator device according to claim 12, further comprising:

a wall surrounding said at least two adjacent dielectric resonators and forming a cavity;

a set of opposed projections extending from said wall into said cavity; and respective recess provided in each of said opposed projections, said partitioning plate positioned within said respective recesses.

18. The dielectric resonator device according to claim 12, wherein said first conductor loop portion and said second conductor loop portion are integrally formed with the partitioning plate.

19. A communication filter comprising:

the dielectric resonator device set forth in claim 12, and an external coupling unit which is externally coupled to the dielectric resonator device.

20. A communication unit for a mobile communication base station, the communication unit comprising:

a high frequency circuit that allows a predetermined band of a communication signal to pass through, the high frequency circuit including the communication filter set forth in claim 19.

* * * * *